US010575692B2

(12) United States Patent
Lim et al.

(10) Patent No.: US 10,575,692 B2
(45) Date of Patent: Mar. 3, 2020

(54) VACUUM CLEANER

(71) Applicant: LG ELECTRONICS INC., Seoul (KR)

(72) Inventors: Hwajin Lim, Seoul (KR); Seongho Park, Seoul (KR); Youngho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 305 days.

(21) Appl. No.: 15/612,039

(22) Filed: Jun. 2, 2017

(65) Prior Publication Data

US 2017/0347850 A1 Dec. 7, 2017

(30) Foreign Application Priority Data

Jun. 2, 2016 (KR) ..... 10-2016-0068943

(51) Int. Cl.

| | |
|---|---|
| ***A47L 9/14*** | (2006.01) |
| ***A47L 5/36*** | (2006.01) |
| ***A47L 9/24*** | (2006.01) |
| ***A47L 9/10*** | (2006.01) |

(52) U.S. Cl.

CPC ..... *A47L 9/149* (2013.01); *A47L 5/362* (2013.01); *A47L 9/106* (2013.01); *A47L 9/1409* (2013.01); *A47L 9/244* (2013.01)

(58) Field of Classification Search

CPC ..... A47L 9/149; A47L 9/106

See application file for complete search history.

(56) References Cited

U.S. PATENT DOCUMENTS

| | | | | |
|---|---|---|---|---|
| 7,740,676 | B2 | 6/2010 | Burnham et al. | |
| 2005/0198767 | A1 * | 9/2005 | Kang | A47L 9/106 15/353 |

FOREIGN PATENT DOCUMENTS

| | | | |
|---|---|---|---|
| JP | 05259223 | A | 8/2013 |
| KR | 2006024592 | A | 3/2006 |
| KR | 100751788 | | 8/2007 |
| KR | 963337 | A | 6/2010 |

* cited by examiner

*Primary Examiner* — Andrew A Horton

(74) *Attorney, Agent, or Firm* — Fish & Richardson P.C.

(57) ABSTRACT

A vacuum cleaner includes a cleaner main body, a suction device, a suction motor, and a dust container. The dust container includes a dust collection body configured to contain dust, an opening/closing portion rotatably coupled to the dust collection body and configured to rotate to thereby open and close at least a portion of the dust collection body, and an operation portion connected to the dust collection body and configured to rotate in both a first direction and a second direction opposite the first direction. The opening/closing portion is configured to rotate based on the operation portion rotating in the first direction, and configured to rotate based on the operation portion rotating in the second direction.

22 Claims, 10 Drawing Sheets

VACUUM CLEANER

CROSS-REFERENCE TO RELATED APPLICATIONS

The present application claims priority under 35 U.S.C. § 119 and 35 U.S.C. § 365 to Korean Patent Application No. 10-2016-0068943 filed on Jun. 2, 2016, all of which is hereby incorporated by reference in its entirety.

BACKGROUND

Field

The present disclosure relates to a vacuum cleaner.

Background

Generally, the vacuum cleaner is a device that sucks dust-containing air using suction force generated by a suction motor mounted inside a main body thereof, and then filters dust inside the main body.

Such a vacuum cleaner is divided into a manual vacuum cleaner and an automatic vacuum cleaner. The manual vacuum cleaner is a vacuum cleaner which performs cleaning directly by users and the automatic vacuum cleaner is a vacuum cleaner which performs cleaning while working by itself.

The manual vacuum cleaner can be divided into a canister type in which a suction nozzle is provided separately from the main body and then is connected by a connection pipe and an upright type in which the suction nozzle is coupled to the main body.

On the other hand, the vacuum cleaner includes a dust container in which the dust sucked through the suction nozzle into the cleaner main body is stored regardless of the type. In order to maintain the suction force of the vacuum cleaner, the user has to periodically empty the dust stored in the dust container.

In a case where the user empties the dust container, the dust container is separated from the cleaner main body and the dust container is opened to shake off the dust inside the dust container.

The registered patent publication No. 10-0751788 (published on Aug. 24, 2007) which is the related art discloses a dust container assembly device for the vacuum cleaner.

According to the related art, there are problems that a hand of the user may be contaminated by the dust stored in the dust container in the process of opening the dust container and that the dust container is opened unintentionally.

In addition, in the process of opening the dust container, the user has to grasp the dust container using one hand and open the dust container using the other hand. At this time, in a case of the hand opening the dust container is not a mainly used hand (that is, a right hand of a right-handed person or a left hand of a left-handed person), it is impossible to apply proper force to the dust container, and thus the user may experience difficulties such as dropping the dust container.

On the other hand, if the dust container is designed to hold the dust container using the left hand and open the dust container using the right hand so that the right-handed person can easily use the dust container, the left-handed person may feel inconvenience in opening the dust container.

SUMMARY

An object of the present invention is to provide a vacuum cleaner which can simply open a dust container.

Another object of the present invention is to provide a vacuum cleaner which can easily open a dust container using either hand of both hands.

In addition, another object of the present invention is to provide a vacuum cleaner in which an operation portion can be operated using same operation force regardless of a rotation direction.

A vacuum cleaner according to one aspect includes a cleaner main body, a suction device which guides dust-containing air to the cleaner main body, a suction motor which is provided in the cleaner main body and provides suction force, and a dust container which stores dust sucked through the suction device.

The dust container includes a dust collection body in which dust is stored, an opening and closing portion for opening and closing the dust collection body, and an operation portion which is connected to the dust collection body to be rotatable in both directions and can open the dust collection body by rotating the opening and closing portion even in a case where the operation portion is rotated in either direction of both directions.

The vacuum cleaner may further include a first elastic member which is contracted when the operation portion is rotated in one direction, and a second elastic member which is contracted when the operation portion rotates in the other direction, so as to be capable of returning to an initial position even in a case where the operation portion is rotated in either direction of both directions.

Each of the elastic members may be a coil spring.

The dust collection body may include a first support portion for supporting one end of each elastic member and the operation portion may include a second support portion for supporting the other end of each elastic member.

The operation portion may be formed in an arch shape so that the elastic member can be arranged in a rounded state and may further include a third support portion which forms an elastic member accommodation portion in which each of the elastic members is accommodated, together with the first support portion and the second support portion.

The operation portion may include an operation body, a protrusion portion which protrudes from a rim of the operation body, and inclined portions which are formed at both end portions of the protrusion portion.

One inclined portion of the inclined portions formed at both end portions of the protrusion portion may press the opening and closing portion in a process of rotating the operation portion.

The dust collection body may include a fixing protrusion, and the opening and closing portion may include a fixing portion which is fixed to the fixing protrusion in a state where the dust collection body is closed.

In a state where the opening and closing portion closes the dust collection body, a portion of the fixing portion may be positioned in a space between the inclined portions at both ends of the protrusion portion.

The fixing portion may include an interference portion which interferes with the inclined portion in the process of rotating the operation portion and a hooking portion which protrudes from the interference portion and is hooked to the fixing protrusion.

The hooking between the hooking portion and the fixing protrusion may be released by one inclined portion of the inclined portions at both ends of the protrusion portion pressing the interference portion when the fixing portion is rotated in one direction.

The inclined portion may include a first inclined surface facing a front lower side and a second inclined surface facing a front upper side. A boundary portion may be formed between the first inclined surface and the second inclined surface, and the boundary portion and the second inclined surface may be sequentially in contact with the hooking portion in a process of rotating the operation portion in one direction.

The operation body may be provided with a handle for gripping by a user.

DETAILED DESCRIPTION

Figure 1:
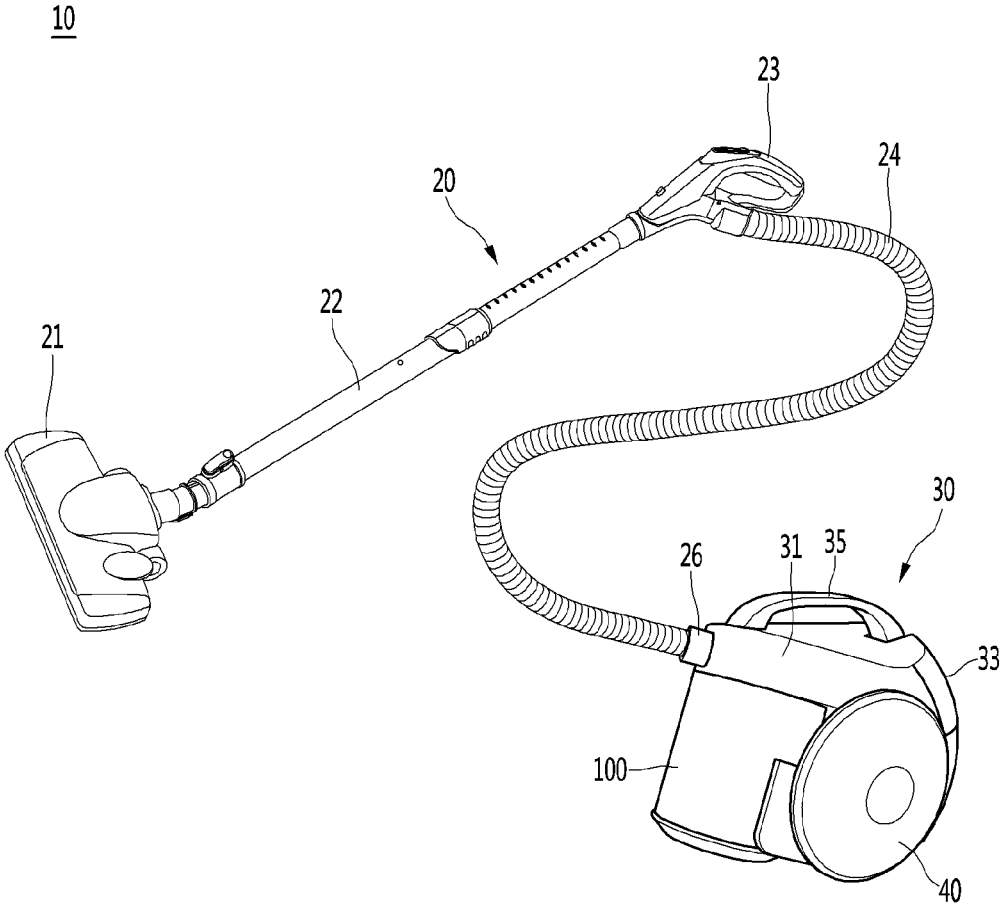
FIG. 1 is a perspective view illustrating a vacuum cleaner according to an embodiment of the present invention.

Hereinafter, some embodiments of the present invention will be described in detail with reference to exemplary drawings. In adding reference numerals to the components of the respective drawings, it should be noted that the same components are denoted by the same reference symbols as possible even if they are illustrated in different drawings. In addition, in the description of embodiments of the present invention, a specified description of related and known configurations or functions will be omitted in a case where it is determined as hindering the understanding of the embodiments of the present invention.

In addition, in describing the components of the embodiment of the present invention, terms such as first, second, A, B, (a), and (b) may be used. These terms are intended to distinguish the components from other components, and the terms do not limit the nature, the order or the sequence of the components. In a case where a component is described as being "attached", "coupled", or "connected" to another component, although the component may be directly attached or connected to the other component, it is to be understood that another component may be "attached", "coupled", or "connected" between components, respectively.

Figure 2:
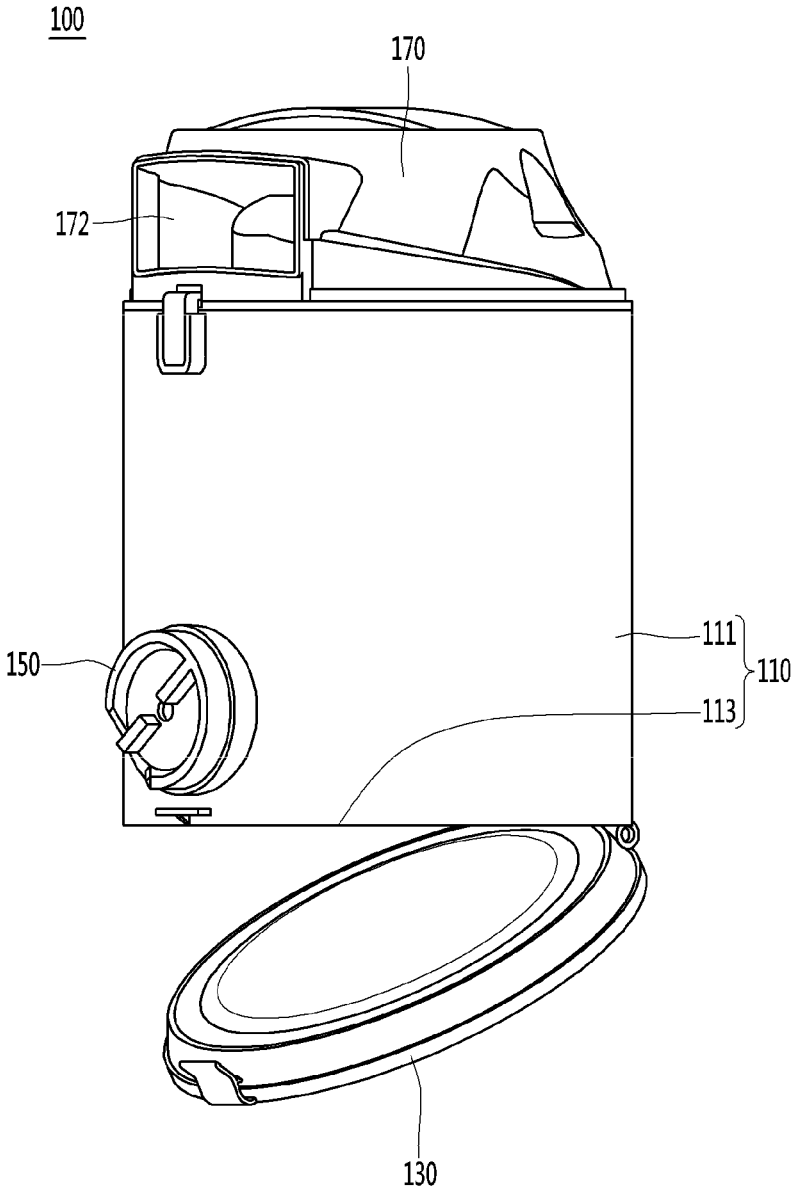
FIG. 2 is a perspective view illustrating a dust container according to the embodiment of the present invention.
Figure 3:
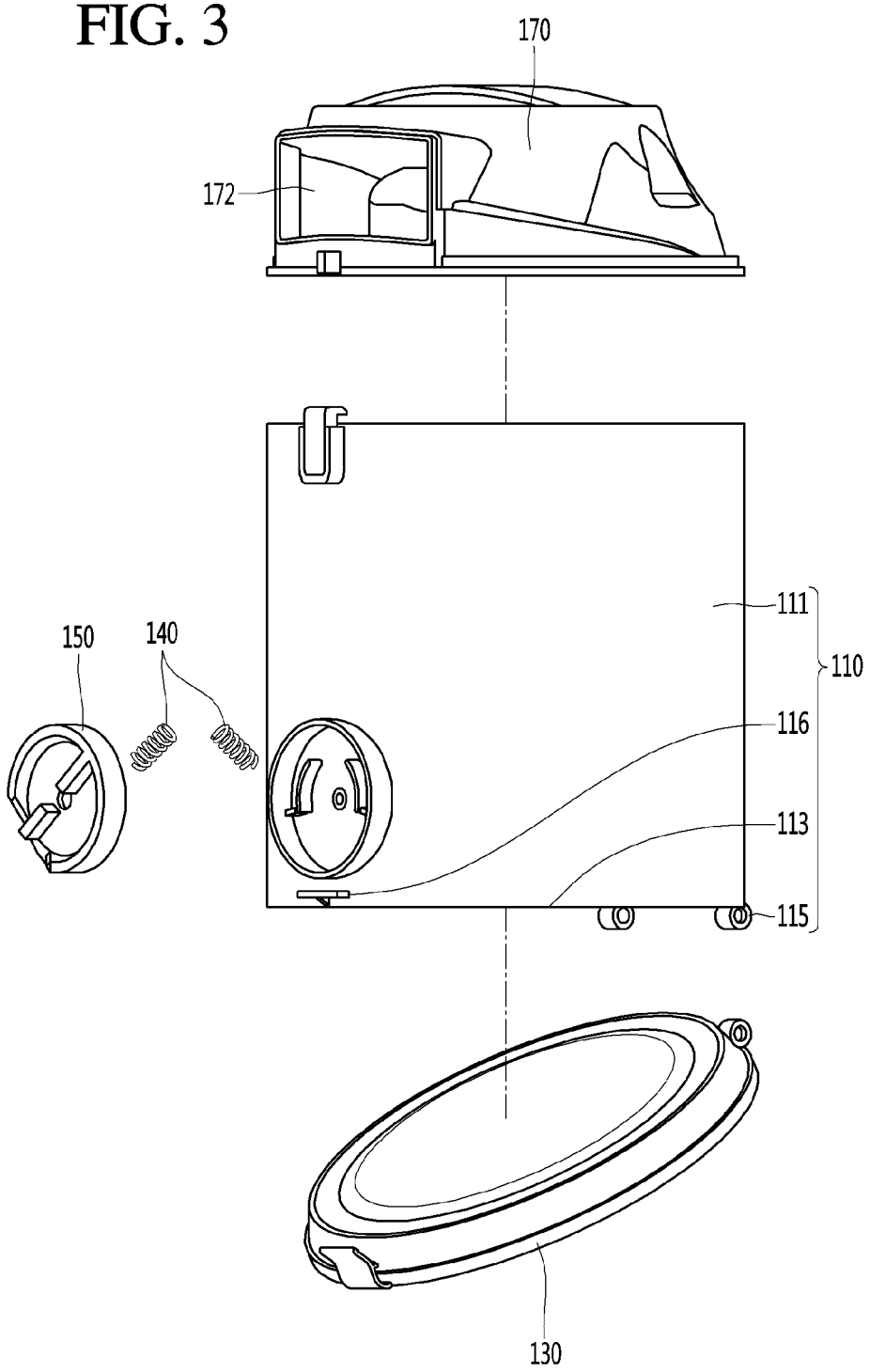
FIG. 3 is an exploded perspective view of the dust container according to the embodiment of the present invention.

FIG. 1 is a perspective view illustrating a vacuum cleaner according to an embodiment of the present invention, FIG. 2 is a perspective view illustrating a dust container according to the embodiment of the present invention, and FIG. 3 is an exploded perspective view of the dust container according to the embodiment of the present invention.

With reference to FIG. 1 to FIG. 3, a vacuum cleaner 10 according to an embodiment of the present invention includes a suction device 20 and a cleaner main body 30 which is connected to the suction device 20 and sucks air from the suction device 20.

The suction device 20 can guide dust-containing air to the cleaner main body 30. The suction device 20 may include a suction portion 21 for suctioning dust on a floor surface as an example of a surface to be cleaned and a connection portion 22, 23, and 24 for connecting the suction portion 21 to the cleaner main body 10.

The connection portions 22, 23 and 24 may include an extension pipe 22 which extends from the suction portion 21, a handle 23 which is connected to the extension pipe 22, and a suction hose 24 which connects the handle 23 to the cleaner main body 30.

The cleaner main body 30 may include a dust container 100 for separating dust and storing the separated dust.

The dust container 100 may be made of a transparent material so that the user can identify an inside portion thereof. In addition, the dust container 100 may be detachably mounted to the cleaner main body 30. At this time, the dust container 100 may be separated in a front direction of the cleaner main body 30. In this case, the front direction may mean a direction toward the suction device 20 with respect to the cleaner main body 30. A detailed description with respect to the dust container 100 will be described later.

The cleaner main body 30 may further include a main body cover 31 covering an upper side of the dust container 100.

A holder 26 to which the suction hose 23 is coupled is provided on a side of the main body cover 31 and dust-containing air can be sucked to the inside of the dust container 100 through the holder 26.

The main body cover 31 may be provided on an upper portion of the cleaner main body 30. As an example, the main body cover 31 may be rotatably connected to the cleaner main body 30 by a hinge (not illustrated).

The cleaner main body 30 may further include a motor portion 33 for sucking dust separated air from the dust container 100. The motor portion 33 may include a suction motor (not illustrated).

The suction motor generates suction force. When the suction motor is driven to generate the suction force, the dust-containing air can be guided to the dust container 100 through the suction device 20. Air and dust guided to the dust container 100 are separated from each other in the dust container 100 and dust separated air is discharged from the dust container 100. On the other hand, the dust separated from the air is stored in the dust container 100.

The main body cover 31 may be provided with a handle 35 for gripping by a user. The user can grip the handle 35 when lifting or tilting the cleaner main body 30.

The handle 35 may be provided on the upper portion of the main body cover 31. In addition, the handle 35 may extend in the front and rear direction of the cleaner main body 30 and may be rounded upward.

The cleaner main body 30 may further include a moving wheel 40. The moving wheel 40 can move the cleaner main body 30.

On the other hand, the dust container 100 includes a dust collection body 110 in which dust is stored and an opening and closing portion 130 which is located under the dust collection body 110.

The dust collection body 110 may include a dust storage portion 111 for storing the dust and a dust discharge portion 113 provided on a lower surface of the dust storage portion 111.

The dust storage portion 111 may include a cylindrical container passing through in a substantially vertical direction. A filter portion (not illustrated) for separating dust from the air sucked from the suction portion 20 may be provided in an inner space of the dust storage portion 111.

The opening and closing portion 130 can be hinged to a lower portion of the dust storage portion 111 and selectively open the dust discharge portion 113. The opening structure of the opening and closing portion 130 will be described later in detail.

The dust container 100 may further include an upper cover 170 positioned on the upper side of the dust collection body 110. The upper cover 170 may be provided with an air suction port 172 and the air sucked from the suction device 20 through the air suction port 172 may be introduced into the dust collection body 110.

In addition, the upper cover 170 may be accommodated in the inner space of the main body cover 31 when the dust container 100 is fastened to the cleaner main body 30 and a side of the suction hose 24 can be fastened to the air suction port 172.

On the other hand, the upper cover 170 may be provided with an air discharge port (not illustrated), and air in which dust is removed from the filter portion may flow to the motor portion 33 through the air discharge port.

Accordingly, the air and the dust introduced through the air suction port 172 are separated by passing through the filter portion, the separated dust is stored in the dust storage portion 111 of the dust collection body 110, and the separated air flows to the motor portion 33 through the air discharge port.

The dust collection body 110 includes a hinge 115 to which the opening and closing portion 130 is rotatably coupled and a fixing protrusion 116 which interferes with the opening and closing portion 130.

The hinge 115 may be provided at a lower end of the dust collection body 110. The opening and closing portion 130 can be vertically rotatable about the hinge 115 and can selectively open the dust discharge portion 113.

The fixing protrusion 116 may be provided on an outer circumferential surface of the dust collection body 111. As an example, the fixing protrusion 116 may be disposed on a lower outer circumferential surface of the dust collection body 110 so as to be adjacent to the dust discharge portion 113.

The fixing protrusion 116 may protrude from the outer circumferential surface of the dust collection body 110.

At this time, it can be understood that the direction in which the fixing protrusions 116 extends with respect to the dust collection body 110 is a front side of the dust collection body 110 and the direction in which the hinge 115 is provided is a rear side of the dust collection body 110.

On the other hand, the dust container 100 may further include an operation portion 150 fastened to a side of the dust collection body 110 and an elastic member 140 for elastically supporting the operation portion 150.

The operation portion 150 may selectively interfere with the opening and closing portion 130 and selectively rotate the opening and closing portion 130.

The elastic member 140 may rotate the operation portion 150 such that the rotated operation portion 150 returns to a position for fixing the opening and closing portion 130 (hereinafter, referred to as "reference position").

Figure 4:
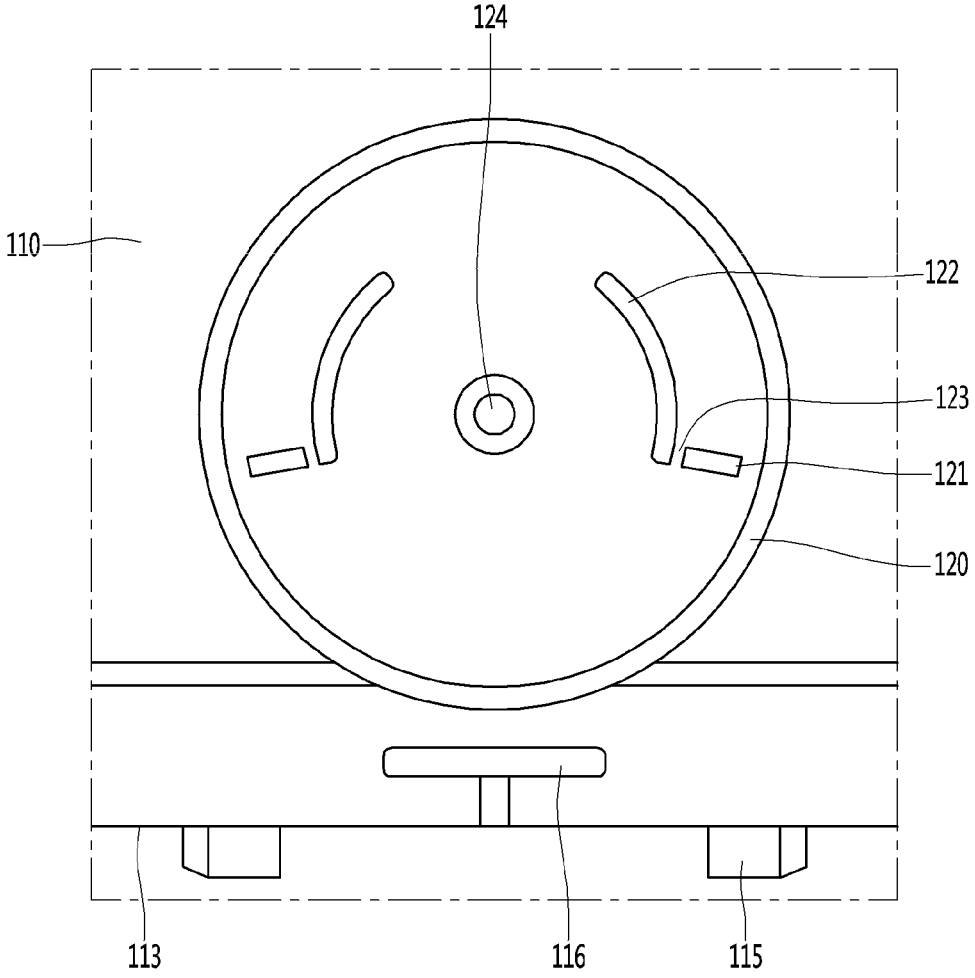
FIG. 4 is a view illustrating a dust collection body according to the embodiment of the present invention.
Figure 5:
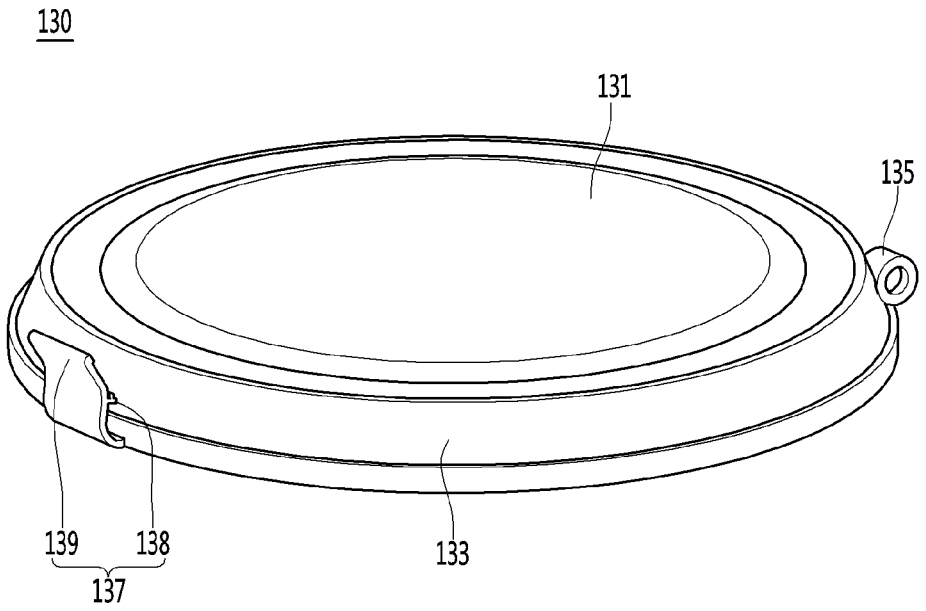
FIG. 5 is a perspective view illustrating an opening and closing portion according to the embodiment of the present invention.
Figure 6:
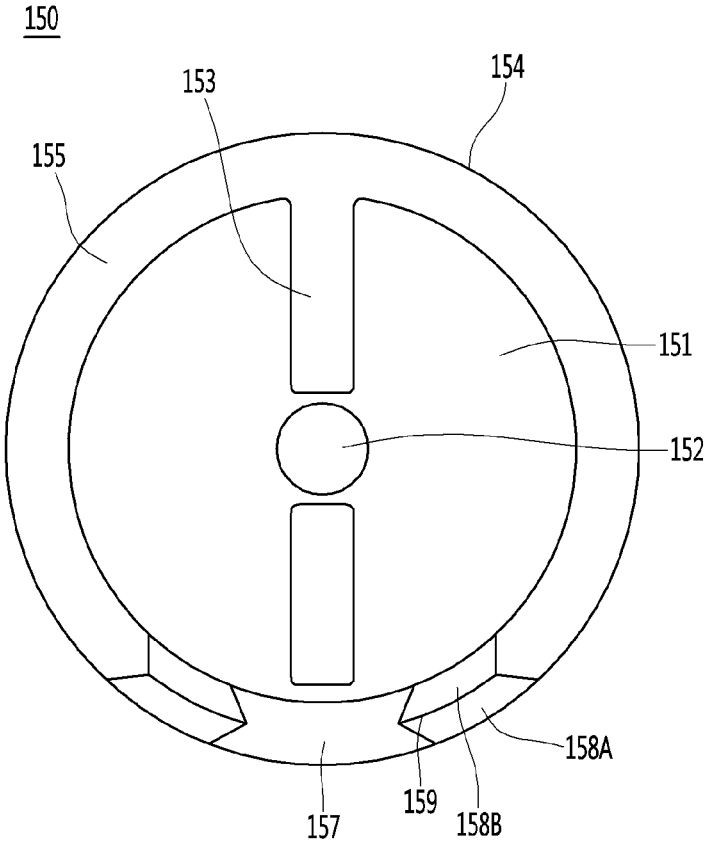
FIG. 6 is a front view illustrating an operation portion according to the embodiment of the present invention.
Figure 7:
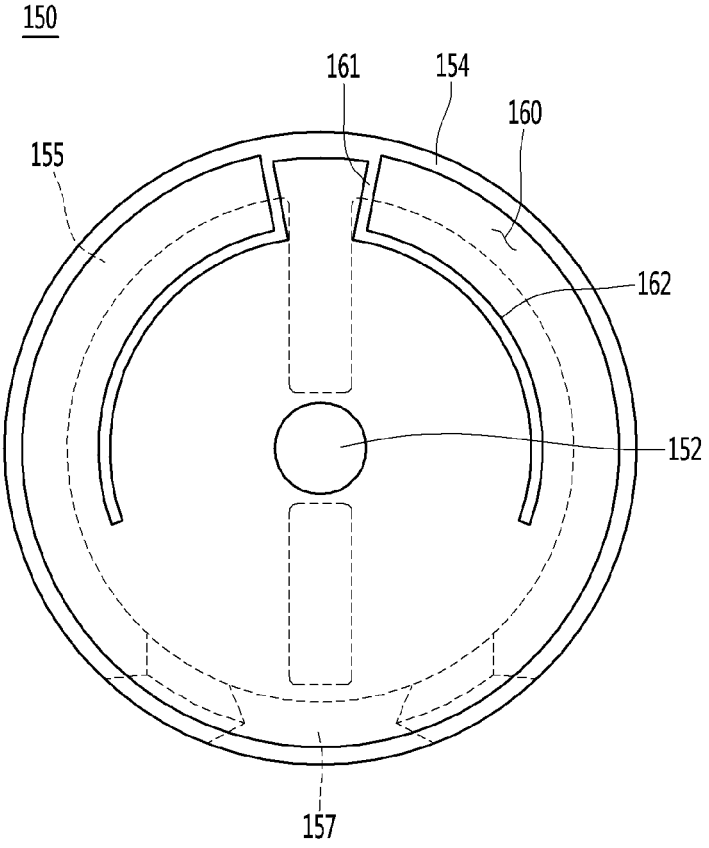
FIG. 7 is a rear view illustrating the operation portion according to the embodiment of the present invention.

FIG. 4 is a view illustrating a dust collection body according to the embodiment of the present invention, FIG. 5 is a perspective view illustrating an opening and closing portion according to the embodiment of the present invention, FIG. 6 is a front view illustrating an operation portion according to the embodiment of the present invention, and FIG. 7 is a rear view illustrating the operation portion according to the embodiment of the present invention.

With reference to FIG. 4 to FIG. 7, the dust collection body 110 may include an accommodation portion 120 in which the operation portion 150 is disposed. The accommodation portion 120 may be provided on the outer circumferential surface of the dust collection body 110 and may be disposed on an upper side of the fixing protrusion 116.

The accommodation portion 120 may protrude from the outer circumferential surface of the dust collection body 110.

At this time, the accommodation portion 120 may extend from the dust collection body 110 such that a front end thereof is located on the same plane. As an example, in a case where the dust collection body 110 has a cylindrical shape, the extending length of both side portions of the accommodation portion 120 may be longer than an extending length of the upper and lower portions thereof.

The accommodation portion 120 may be formed in a ring shape about one point when viewed from a front side. As an example, the accommodation portion 120 may have a ring shape about the center portion 124. The center portion 124 may be provided with a fastening portion for selectively and rotatably fastening the operation portion 150.

The dust collection body 110 may include a first support portion 121 which is disposed inside the accommodation portion 120 and supports the elastic member 140.

One surface of the first support portion 121 may contact the one end of the elastic member 140 to support the elastic member 140.

The dust collection body 110 may include a guide portion 122 which is disposed in an inside portion of the accommodation portion 120 and guides the rotation of the operation portion 150.

The guide portion 122 may be an arch-shaped structure spaced apart from the center portion 124 by a predetermined distance. The guide portion 122 is accommodated in the accommodation portion 120 and guides the operation portion 150 rotated in both directions.

A space portion 123 may be provided between the first support portion 121 and the guide portion 122. The space portion 123 may be penetrated by a third support portion 162 which will be described later.

On the other hand, the opening and closing portion 130 includes an opening and closing body 131 for selectively shielding the dust discharge portion 113, a hinge portion 135 for rotatably fastening the opening and closing body 131 to the dust collection body 110, and a fixing portion 137 for fixing the opening and closing body 131 to the dust collection body 110.

The opening and closing body 131 may have the same shape as the opening shape of the dust discharge portion 113. As an example, the opening and closing body 131 may have a disk shape.

The hinge portion 135 may be rotatably fastened to the hinge 115 of the dust collection body 110. The hinge portion 135 may extend from one side of the opening and closing body 131 and as an example, the hinge portion 135 may extend rearward from the rear side edge of the opening and closing body 131.

The fixing portion 137 may extend from the other side of the opening and closing body 131 and as an example, the fixing portion 137 may be bend and extend so as to face a front side of the dust collection body 110 from the front side edge of the opening and closing body 131. The fixing portion 137 may be selectively hooked to fixing protrusion 116 of the dust collection body 110 to fix the opening and closing body 131 to the dust collection body 110.

The fixing portion 137 includes an interference portion 139 extending from the opening and closing body 131 and a hooking portion 138 extending from a rear surface of the interference portion 139 toward a rear side of the dust collection body 110.

The interference portion 139 may interfere with the operation portion 150 and the hooking portion 138 may be hooked to the fixing protrusion 116.

The operation portion 150 can be rotated in both directions in a state of being accommodated in the accommodation portion 120. The operation portion 150 may interfere with the interference portion 138 of the opening and closing body 131 in a process of rotating the operation portion 150.

The operation portion 150 may include an operation body 151 having a substantial disk shape and an outer circumferential surface portion 154 extending to the operation body 151.

The operation portion 150 further includes a through hole 152 passing through the center of the operation body 151. The through hole 152 may be aligned with the center portion 124 of the dust collection body 110 and the operation portion 150 can be rotatably fastened to the dust collection body 110 by a fastening member (not illustrated) passing through the through hole 152 and being fastened to the fastening portion provided in the center portion 124.

The operation portion 150 may further include a handle 153 projecting from the operation body 151 to a front side. The user can rotate the operation portion 150 using the handle 153.

The operation portion 150 further includes a protrusion portion 155 protruding from a rim portion of the main body 151 toward a front side and a depressed portion 157.

The protrusion portion 155 may be provided on a rim portion of the operation body 151 and the depressed portion 157 may be formed on the other rim portion thereof. As an example, the depressed portion 157 may be formed on a portion of a lower side with respect to the through hole 152, and the protrusion portion 155 may be formed on the remaining rim portion except for the depressed portion 157.

On the other aspect, the protrusion portion 155 protrudes forward from the rim portion of the main body 151 and the depressed portion 157 is provided between the protrusion portions 155 and may be understood that it means a surface which does not protrude from the main body 151.

The protrusion portion 155 is formed in an arch shape, and both ends thereof can be spaced apart from each other. Inclined portions 158A and 158B may be provided at both end portions of the protrusion portion 155.

At this time, the interference portion 139 may be located in a space between the inclined portions 158A and 158B at both ends of the protrusion portion 155 in a state where the opening and closing portion 130 closes the dust collection body 110.

The inclined portions 158A and 158B may extend from a surface positioned at the foremost position of the protrusion portion 155 toward the depressed portion 157. The inclined portions 158A and 158B prevent the formation of a stepped portion between the protrusion portion 155 and the depressed portion 157. The inclined portions 158A and 158B can smoothly press the interference portion 139 according to the rotation of the operation portion 150.

The inclined portions 158A and 158B may include a first inclined surface 158A facing the front lower side and a second inclined surface 158B facing the front upper side and a boundary portion 159 may be formed between the first inclined surface 158A and the second inclined surface 158B.

The boundary portion 159 may refer to a ridge extending from the protrusion portion 155 to the depressed portion 157.

On the other hand, a second support portion 161 extending from the outer circumferential surface portion 154 toward the through hole 152 and a third support portion 162 bending and extending from the second support portion 161 are provided on a rear surface of the operation portion 150.

At this time, a pair of second support portion 161 and a third support portion 162 is provided on the rear surface of the operation portion 150.

The third support portion 162 may be an arch-shaped structure which is spaced apart from the through hole 152 located at the center portion of the operation portion 150 by a predetermined distance and can be formed to face an outer circumferential surface portion 154 each other.

The elastic member accommodation portion 160 may be provided between the second support portion 161, the third support portion 162, and the outer circumferential surface portion 154. The elastic member 140 may be disposed inside the elastic member accommodation portion 160 and both ends of the elastic member 140 may be in contact with the first support portion 121 and the second support portion 161.

Figure 8:
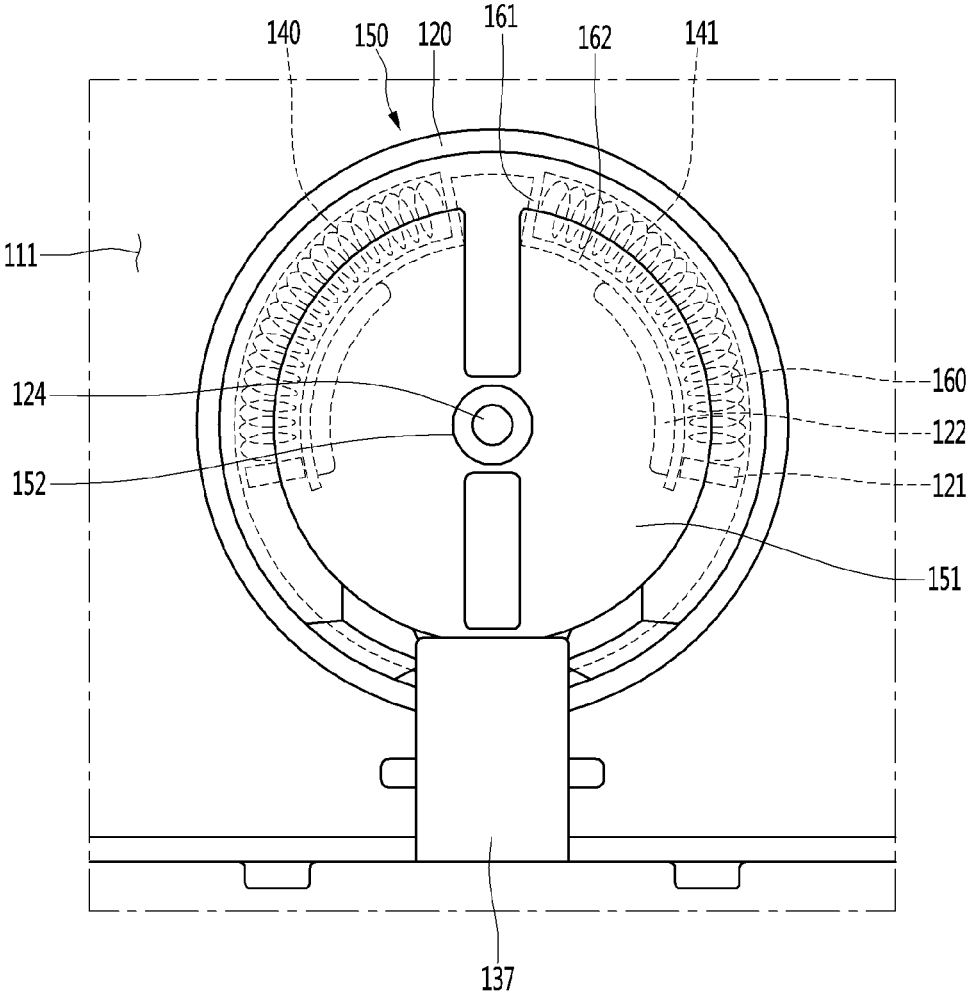
FIG. 8 is a view illustrating a fastening structure of the operation portion and a main body according to an embodiment of the present invention.

FIG. 8 is a view illustrating a fastening structure of an operation portion and a main body portion according to an embodiment of the present invention.

With reference to FIG. 8, the operation portion 150 is disposed in an inner space of the accommodation portion 120. At this time, the fastening member (not illustrated) is inserted into the through hole 152 and fixed to the fastening portion 124. Therefore, the operation portion 150 is rotatable in the clockwise direction or in the counterclockwise direction in the inner space of the accommodation portion 120.

A plurality of elastic members 140 and 141 may be disposed between the operation portion 150 and the dust collection body 110. The elastic member may be a coil spring as an example. More specifically, each of the plurality of elastic members 140 is disposed in the elastic member accommodation portion 160 located on the rear surface of the operation portion 150.

The plurality of elastic members 140 and 141 includes a first elastic member 140 which is contracted when the operation portion 150 is rotated in a first direction (as an example, a counterclockwise direction) and a second elastic member 140 which is contracted when the operation portion 150 is rotated in a second direction (as an example, a clockwise direction) opposite to the first direction.

The operation portion 150 is provided with elastic force for rotating in the second direction by the first elastic member 140 and the operation portion 150 is provided with elastic force for rotating in the first direction by the second elastic member 141.

At this time, one end of the elastic member 140 is in contact with the first support portion 121 and the other end of the elastic member 140 is in contact with the second support portion 161. In addition, the third support portion 162 may be inserted into the space portion 123.

When the operation portion 150 is rotated in the second direction (clockwise direction in FIG. 9), the fixing portion 137 is moved forward by the protrusion portion 155 and the hooking between the hooking portion 138 and the fixing portion 116 can be released.

When the operation portion 150 is rotated in the second direction (clockwise direction in FIG. 9), the second elastic member 141 is contracted. In this state, when operating force of the operation portion 150 is removed, the operation portion 150 is rotated in the first direction by the elastic force of the second elastic member 141 to return to the reference position.

The return to the reference position of the operation portion 150 can be operated in the same manner even in a case where the operation portion 150 is rotated in the counterclockwise direction.

In order to separate the dust container in the manner described above, since the user can rotate the operation portion in the clockwise direction or in a counterclockwise direction, operability can be improved and the dust container can be easily opened using a hand which is not mainly used.

Figure 9:
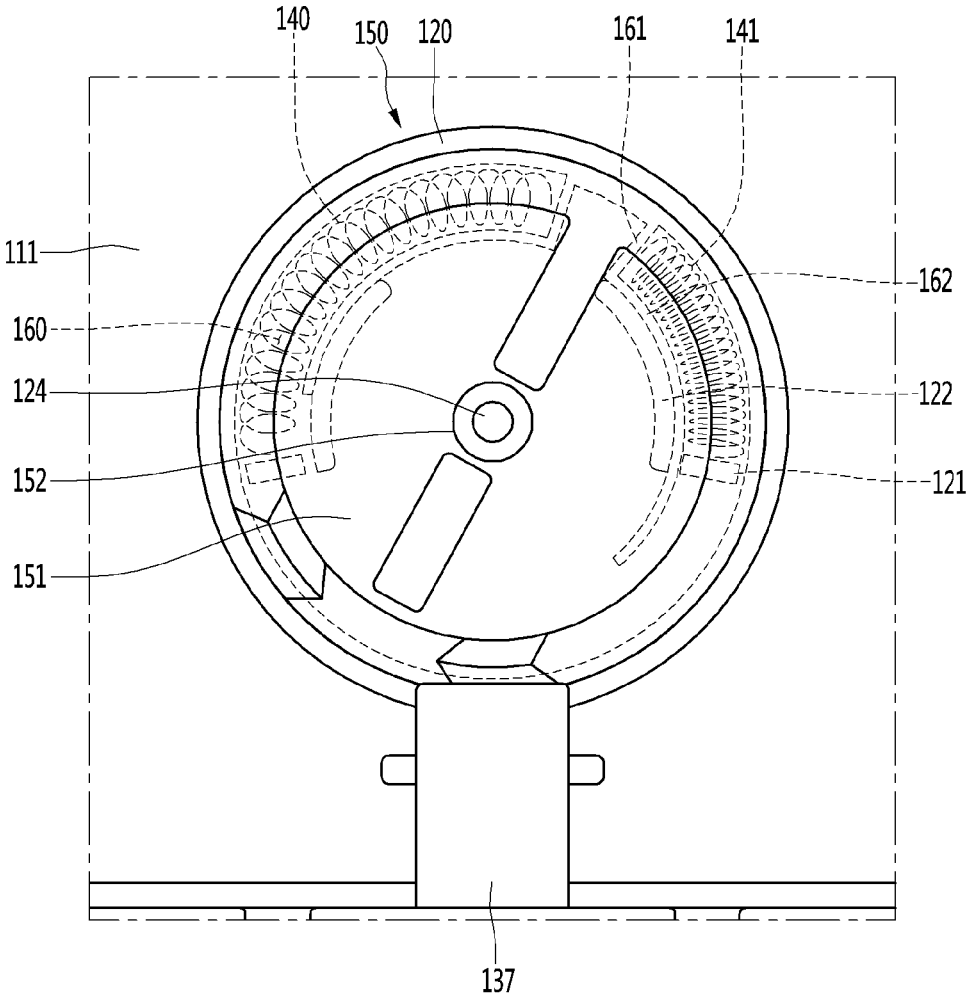
FIG. 9 is a view illustrating a state where the operation portion is rotated in one direction according to the embodiment of the present invention.
Figure 10:
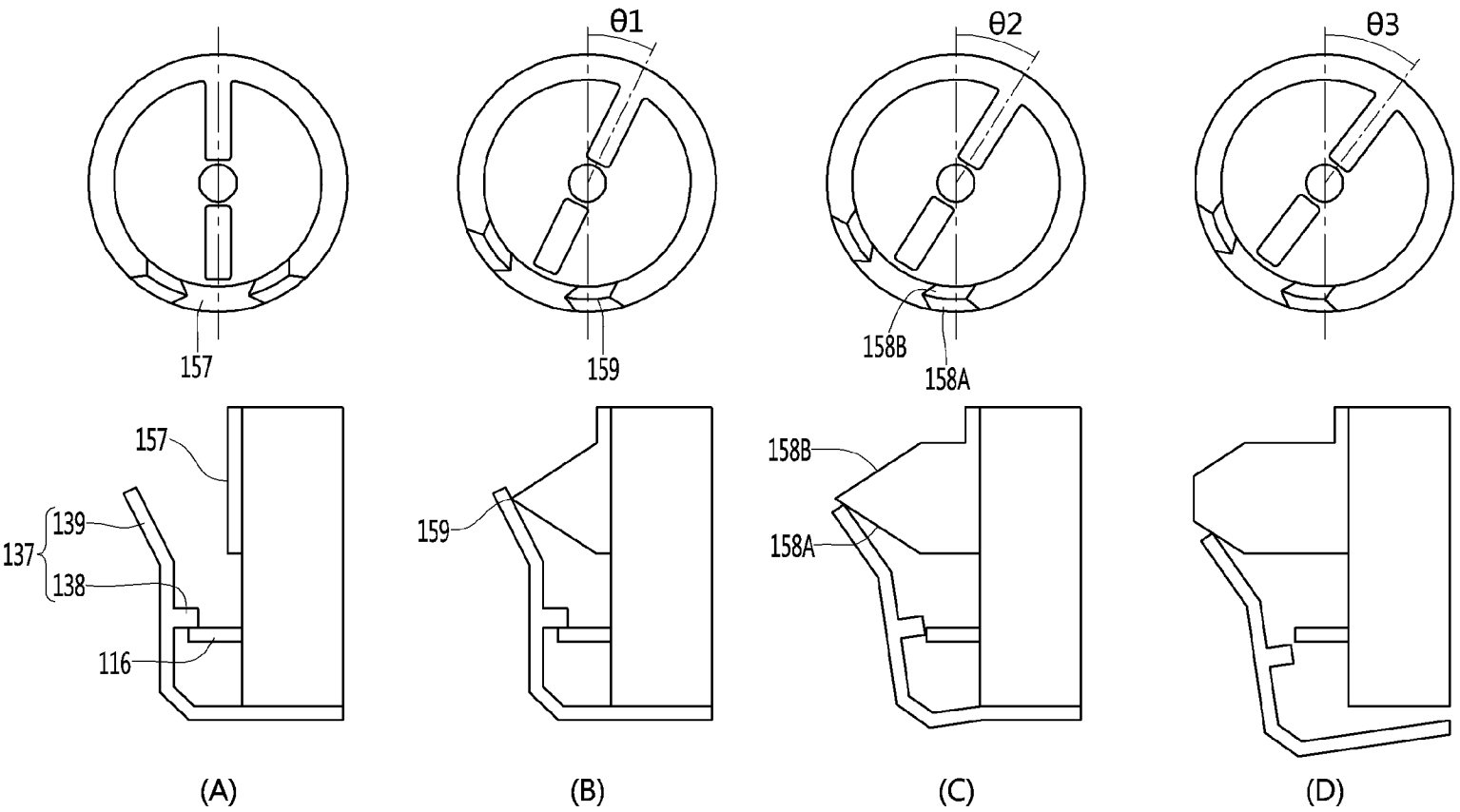
FIG. 10 is a view illustrating a process of opening the dust container according to an operation of the operation portion according to the embodiment of the present invention.

FIG. 9 is a view illustrating a state where the operation portion is rotated in one direction according to the embodiment of the present invention, and FIG. 10 is a view illustrating a process of opening the dust container according to an operation of the operation portion according to the embodiment of the present invention.

With reference to FIG. 9 and FIG. 10A, in a case where no rotational force is applied to the operation portion 150, that is, in a case where the operation portion 150 is disposed at the reference position, since hooking is performed between the hooking portion 138 and the fixing protrusions 116 and the interference is not performed between the interference portion 139 and the depressed portion 157, the opening and closing portion 130 is not opened.

On the other hand, when the operation portion 150 is rotated by a predetermined angle θ1 as illustrated in FIG. 10B, interference is started to be generated between the boundary 159 of the operation portion 150 and the interference portion 139.

When the operation portion 150 is further rotated by a predetermined angle θ2 as illustrated in FIG. 10C, the boundary portion 159 pushes the interference portion 139 forward, and the hooking is released between the hooking portion 138 and the fixing projection 116. At this time, since the opening and closing portion 130 moves downward, the interference portion 139 can be in contact with the first inclined surface 158A.

When the operation portion 150 is further rotated by a predetermined angle θ3 as illustrated in FIG. 10D, the first inclined surface 158A pushes the interference portion 139 downward. Since the hooking between the hooking portion 138 and the fixing protrusion 116 is in a state of being released, the lower cover 130 can be opened.

Accordingly, since the release of the hooking and the opening of the opening and closing portion can be performed at the same time only by the operation of the operation portion 150, the hands of the user are prevented from getting dirty and the user can easily open the dust container using either hand of both hands.

What is claimed is:

1. A vacuum cleaner comprising:

a cleaner main body;

a suction device configured to suction dust-containing air and to guide the suctioned dust-containing air to the cleaner main body;

a suction motor located within the cleaner main body and configured to provide suction force; and a dust container configured to receive dust that has been suctioned through the suction device, the dust container including:

a dust collection body configured to contain the dust, an opening/closing portion rotatably coupled to the dust collection body and configured to rotate to thereby open and close at least a portion of the dust collection body, and an operation portion connected to the dust collection body and configured to rotate in both a first direction and a second direction opposite the first direction, wherein the operation portion is configured, based on rotating in the first direction, to cause the opening/closing portion to rotate to open at least the portion of the dust collection body, and further configured, based on rotating in the second direction, to cause the opening/closing portion to rotate to open at least the portion of the dust collection body.

2. The vacuum cleaner according to claim 1, further comprising:

a first elastic member that is configured, based on the operation portion rotating in the first direction, to be compressed; and a second elastic member that is configured, based on the operation portion rotating in the second direction, to be compressed.

3. The vacuum cleaner according to claim 2, wherein the dust collection body includes a first support portion that supports a first end of each of the first and second elastic members, and wherein the operation portion includes a second support portion that supports a second end of each of the first and second elastic members.

4. The vacuum cleaner according to claim 3, wherein the operation portion has an arch shape and further includes a third support portion, and wherein the first, second, and third support portions define an elastic member accommodation portion that accommodates each of the first and second elastic members.

5. The vacuum cleaner according to claim 1, wherein the operation portion includes:

an operation body;

a protrusion portion that protrudes from a rim of the operation body, the protrusion portion having a pair of ends that are spaced apart from each other; and a pair of inclined portions, each of the pair of inclined portions extending from each of the pair of ends of the protrusion portion.

6. The vacuum cleaner according to claim 5, wherein the dust collection body includes a fixing protrusion, wherein the opening/closing portion includes a fixing portion that is configured, based on the dust collection body closing the dust collection body, to couple to the fixing protrusion, and wherein, based on the opening/closing portion closing the dust collection body, a portion of the fixing portion is positioned in a space defined between the pair of inclined portions.

7. The vacuum cleaner according to claim 6, wherein the fixing portion includes:

an interference portion that is configured, based on the rotation of the operation portion, to interfere with one of the pair of inclined portions; and a hooking portion that protrudes from the interference portion toward the dust collection body, the hooking portion being configured to selectably couple to the fixing protrusion, wherein the hooking portion is configured to be uncoupled from the fixing protrusion based on one of the pair of inclined portions pressing the interference portion to a predetermined position, and wherein the fixing portion is configured, based on one of the pair of inclined portions pressing the interference portion, to become spaced apart from the fixing protrusion to thereby uncouple the hooking portion from the fixing protrusion.

8. The vacuum cleaner according to claim 7, wherein each of the pair of inclined portions includes:

a first inclined surface facing a front lower side;

a second inclined surface facing a front upper side; and a boundary portion defined between the first inclined surface and the second inclined surface, and wherein the boundary portion is configured, based on the operation portion rotating in the first direction or the second direction, to contact the fixing portion before the first inclined surface contacts the fixing portion.

9. The vacuum cleaner according to claim 7, wherein the fixing portion has an end that is spaced apart from a surface of the dust collection body based on the opening/closing portion closing the dust collection body.

10. The vacuum cleaner according to claim 7, wherein the fixing portion is configured, based on one of the pair of inclined portions pressing the interference portion, to elastically deform to thereby become spaced apart from the fixing protrusion.

11. The vacuum cleaner according to claim 7, wherein, based on the hooking portion being coupled to the fixing protrusion, the hooking portion is located vertically above the fixing protrusion.

12. The vacuum cleaner according to claim 6, wherein the operation portion is located vertically above the fixing protrusion.

13. The vacuum cleaner according to claim 5, wherein the operation body includes a handle configured to be gripped by a user.

14. The vacuum cleaner according to claim 5, wherein the operation portion further includes a center portion located in the operation body, and wherein the center portion defines a hole configured to receive a fastening member.

15. The vacuum cleaner according to claim 1, wherein the dust collection body defines an opening at a bottom portion, and wherein the opening/closing portion is configured to open and close the opening at the bottom portion.

16. The vacuum cleaner according to claim 15, wherein the dust collection body includes a hinge at the bottom portion, and wherein the opening/closing portion includes a hinge portion that protrudes from a first position at a circumference of the opening/closing portion, the hinge portion being configured to couple to the hinge.

17. The vacuum cleaner according to claim 16, wherein the opening/closing portion includes a fixing portion that protrudes from a second position at the circumference opposite the first position, the operation portion facing toward the hinge portion.

18. The vacuum cleaner according to claim 1, wherein the operation portion is configured to rotate in both the first direction and the second direction about a rotation axis that passes through the dust collection body.

19. The vacuum cleaner according to claim 1, wherein the operation portion is configured to:

based on rotating in the first direction from a reference position, cause the opening/closing portion to rotate to open at least the portion of the dust collection body; and based on rotating in the second direction from the reference position, cause the opening/closing portion to rotate to open at least the portion of the dust collection body.

20. A vacuum cleaner comprising:

a cleaner main body;

a suction device configured to suction dust-containing air and to guide the suctioned dust-containing air to the cleaner main body;

a suction motor located within the cleaner main body and configured to provide suction force; and a dust container configured to receive dust that has been suctioned through the suction device, the dust container including:

a dust collection body configured to contain the dust, the dust collection body defining a dust discharge portion, an opening/closing portion rotatably coupled to the dust collection body, the opening/closing portion being configured to rotate to thereby open and close at least a portion of the dust discharge portion, and an operation portion connected to the dust collection body and configured to rotate in both a first direction and a second direction opposite the first direction, wherein the operation portion is configured, based on rotating in the first direction, to cause the opening/closing portion to rotate to open at least the portion of the dust collection body, and further configured, based on rotating in the second direction, to cause the opening/closing portion to rotate to open at least the portion of the dust collection body, wherein the opening/closing portion includes a fixing portion configured to selectably couple to the dust collection body, and wherein the operation portion is configured to interfere with the fixing portion.

21. The vacuum cleaner according to claim 20, wherein the operation portion includes:

an operation body;

a protrusion portion that protrudes from a rim of the operation body; and an inclined portion that extends from an end of the protrusion portion and that is configured to interfere with the fixing portion.

22. The vacuum cleaner according to claim 20, wherein the dust collection body includes a fixing protrusion, and wherein the fixing portion is configured, based on the opening/closing portion closing the dust discharge portion, to couple to the fixing protrusion.

* * * * *